US011225368B1

(12) United States Patent
Hakim

(10) Patent No.: US 11,225,368 B1
(45) Date of Patent: Jan. 18, 2022

(54) VENTED SEALABLE BAG

(71) Applicant: Nouri E. Hakim, Monroe, LA (US)

(72) Inventor: Nouri E. Hakim, Monroe, LA (US)

( * ) Notice: Subject to any disclaimer, the term of this patent is extended or adjusted under 35 U.S.C. 154(b) by 0 days.

(21) Appl. No.: 16/929,947

(22) Filed: Jul. 15, 2020

(51) Int. Cl.
*B65D 81/34* (2006.01)
*B65D 33/25* (2006.01)
*B65D 33/01* (2006.01)

(52) U.S. Cl.
CPC ..... *B65D 81/3461* (2013.01); *B65D 33/01* (2013.01); *B65D 33/2508* (2013.01); *B65D 2581/3437* (2013.01)

(58) Field of Classification Search
CPC ..... B65D 81/3461; B65D 33/01; B65D 33/2508; B65D 2581/3437
USPC ..... 383/103
See application file for complete search history.

(56) References Cited

U.S. PATENT DOCUMENTS 3,399,822 A * 9/1968 Kugler ..... B65D 33/01 383/103
10,336,488 B1 * 7/2019 Kjelson ..... B65B 31/048
2012/0027323 A1 * 2/2012 Vitallo ..... B65D 77/225 383/100
2013/0064481 A1 * 3/2013 Yamamoto ..... B32B 3/30 383/200
2018/0251267 A1 * 9/2018 Finell ..... A47G 19/2205

FOREIGN PATENT DOCUMENTS

JP 03212355 A * 9/1991

* cited by examiner

*Primary Examiner* — Jes F Pascua

(57) ABSTRACT

A vented sealable bag comprises a container, a two-part seal and a vent. The container has opposing sidewalls and a bottom defining a cavity. The sidewalls form a neck defining an opening opposite the bottom, The sidewalls have an inner surface facing the cavity and an outer surface external to the container and the sidewalls have a thickness. A two-part seal is formed on the inner surface of the sidewalls adjacent the neck. The two-part seal has a hook formed on one sidewall and a clasp formed on an opposite sidewall. The hook and clasp are arranged on the inner surface of the sidewalls to form an airtight seal isolating the cavity from an external environment when the hook is embedded in the clasp but otherwise maintain the opening in the container. A vent is integrally formed in one of the sidewalls. The vent is further comprised of a dimple having a thickness that is thinner than the thickness of the sidewalls. The dimple is concave when viewed from the cavity and has a slit formed at an apex that is closed except when the container is sealed and an internal pressure is created that is higher than an external pressure on the outer surface of the sidewalls.

11 Claims, 2 Drawing Sheets

VENTED SEALABLE BAG

FIELD OF THE DISCLOSURE

The present disclosure relates generally to food storage containers and, more particularly, to a vented sealable bag.

BACKGROUND

It has long been desirable to provide food storage bags with a vent making them suitable for use in cooking food items in a microwave oven. The vent is necessary during the cooking process as pressure builds and if no relief is provided an explosion can result that if not damaging to the microwave can create an awful mess. Numerous solutions have been proposed. U.S. Pat. No. 9,346,589 is exemplary. It describes a resealable bag with a one-way release valve. Another example is described in U.S. Pat. No. 8,061,899. Various examples of valves intended for use with resealable bags are described in U.S. Pat. Nos. 8,066,433 and 8,074,685. All of these examples suffer from the problem that the valves are formed separately from the bag and are fastened to the bag after the bag has been constructed. This not only increases manufacturing costs but the bags may leak where the valve is attached to the bag and can also create a safety hazard should the valve become separated from the bag. Thus, a heretofore unaddressed need exists in the industry to address the aforementioned deficiencies and inadequacies.

SUMMARY

A vented sealable bag comprises a container, a two-part seal and a vent. The container has opposing sidewalls and a bottom defining a cavity. The sidewalls form a neck defining an opening opposite the bottom. The sidewalls have a thickness, an inner surface facing the cavity, and an outer surface external to the container. A two-part seal is formed on the inner surface of the sidewalls adjacent the neck. The two-part seal has a hook formed on one sidewall and a clasp formed on an opposite sidewall. The hook and clasp are arranged on the inner surface of the sidewalls to form an airtight seal isolating the cavity from an external environment when the hook is embedded in the clasp but otherwise maintain the opening in the container. A vent is integrally formed in one of the sidewalls. The vent is further comprised of a dimple having a thickness that is thinner than the thickness of the sidewalls. The dimple is concave when viewed from the cavity and has a slit formed at an apex that is closed except when the container is sealed and an internal pressure is created that is higher than an external pressure on the outer surface of the sidewalls. In another embodiment, the sidewalls have a thickness in the range of 0.075 inches to 0.095 inches. In another embodiment, the sidewalls have a thickness in the range of 0.075 inches to 0.095 inches and the dimple has a thickness in the range of 0.025 inches to 0.045 inches. In another embodiment, the vented sealable bag is constructed of a flexible polymeric material. In another embodiment, the vented sealable bag is constructed of silicone. In another embodiment, the bottom forms a rectangular platform. In another embodiment, the bottom forms a platform sufficient to support the vented sealable bag.

In another embodiment, a vented sealable bag comprises a container, a two-part seal and a vent. The container has two opposing sidewalls and a bottom that define a cavity. The sidewalls form a neck defining an opening opposite the bottom. The sidewalls have an inner surface facing the cavity and an outer surface external to the container. The sidewalls have a thickness. A two-part seal is formed on the inner surface of the sidewalls below the neck. The two-part seal has a hook formed on one sidewall and a clasp formed on an opposite sidewall. The hook and clasp are arranged on the inner surface of the sidewalls to form a seal preventing contents of the container from communicating with an external environment when the hook is embedded in the clasp but otherwise maintain the opening in the container. A vent is integrally formed in one of the sidewalls. The vent is further comprised of a dimple. The dimple is concave when viewed from the cavity and has a cut opening that forms an airtight seal except when the two-part seal is closed and an internal pressure is created that is higher than an external pressure on the outer surface of the sidewalls. In another embodiment, the vent has a dimple thickness equal to or greater than the thickness of the sidewalls. In another embodiment, the container, two-part seal and the vent are constructed of a flexible material. In another embodiment, the container, two-part seal and the vent are constructed of silicone. In another embodiment, the cut opening is a slit. In another embodiment, the cut opening is a duck bill valve.

In another embodiment, a vented sealable bag comprises a container, a two-part seal and a vent. The container has two opposing sidewalls and a bottom. The sidewalls and bottom define a cavity. The bottom forms a platform. The sidewalls form a neck defining an opening opposite the bottom. The sidewalls have an inner surface facing the cavity and an outer surface external to the container. A two-part seal is formed on the inner surface of the sidewalls below the neck. The two-part seal has a hook formed on one sidewall and a clasp formed on an opposite sidewall. The hook and clasp are arranged on the inner surface of the sidewalls to form a seal preventing contents of the container from communicating with an external environment when the hook is embedded in the clasp in a closed condition but otherwise maintain the opening in the container when the hook and clasp are in an open condition. A vent is integrally formed in one of the sidewalls. The vent is further comprised of a dimple. The dimple is concave when viewed from the cavity and has an opening that forms an airtight seal except when an internal pressure in the cavity is greater than an external pressure on the outer surface of the sidewalls. In another embodiment, the container, two-part seal and the vent are constructed of an impermeable flexible material. In another embodiment, the container, two-part seal and the vent are constructed of silicone. In another embodiment, the platform forms a flat surface sufficient to support the container and its contents. In another embodiment, the container, two-part seal and the vent are constructed of the same material. In another embodiment, the dimple opening is a slit. In another embodiment, the dimple opening is a one-way valve.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
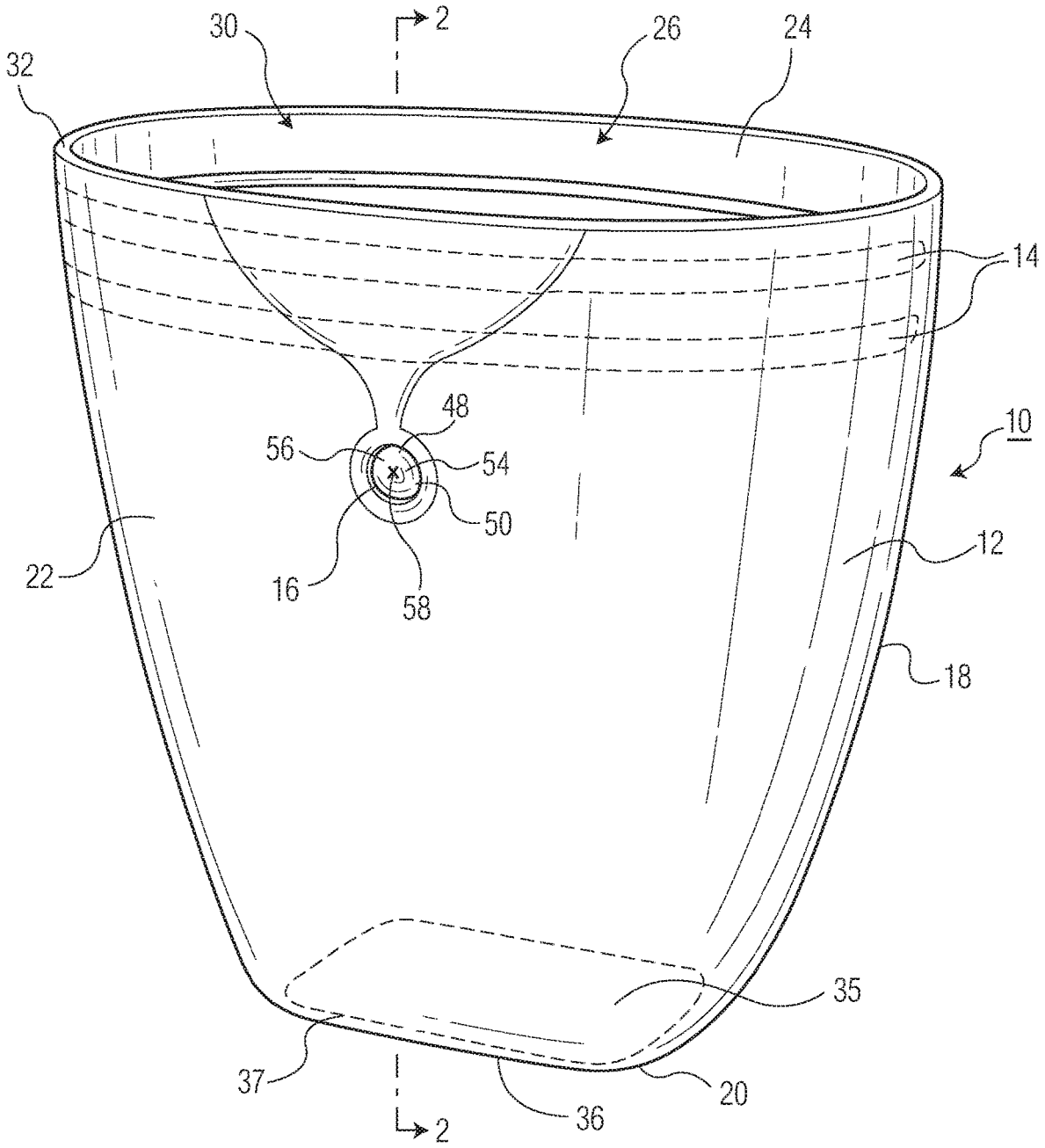
FIG. 1 is a plan view of an embodiment of the vented sealable bag of the present invention.

Reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

Referring now to FIG. 1, a plan view of an embodiment of the vented sealable bag of the present invention, the vented sealable bag 10 is comprised of a container 12 having a two-part seal 14 and a vent 16. Container 12 has two opposing sidewalls 18 and a bottom 20. The sidewalls are comprised of one sidewall 22 and an opposite sidewall 24. The sidewalls 18 and bottom 20 together define a cavity 26 for holding contents 28 (not shown) such as food items suitable for heating in a microwave oven. Opposite bottom 20 is opening 30 defined by neck 32. Adjacent and below neck 32 is two-part seal 14. Container 12 is shown in open condition 34. Bottom 20 forms a platform 36 that forms flat surface 35 that in a preferred embodiment forms a rectangular platform 37 but other shapes are within the scope of the present invention. Vent 16 is formed in sidewalls 18 and is constructed of the same material as sidewalls 18. Vent 16 includes dimple 50 that is concave when viewed from the cavity. Dimple 50 includes apex 56 with cut opening 54 in the preferred embodiment is in the form of a slit 58. Cut opening 54 forms a one-way valve 48 that permits the flow of gas out of the container. Cut opening 54 of one-way valve 48 is closed except when container 12 and opening 30 are sealed and an internal pressure within cavity 26 is greater or higher than an external pressure on outer surface 44 of sidewalls 18.

Figure 2:
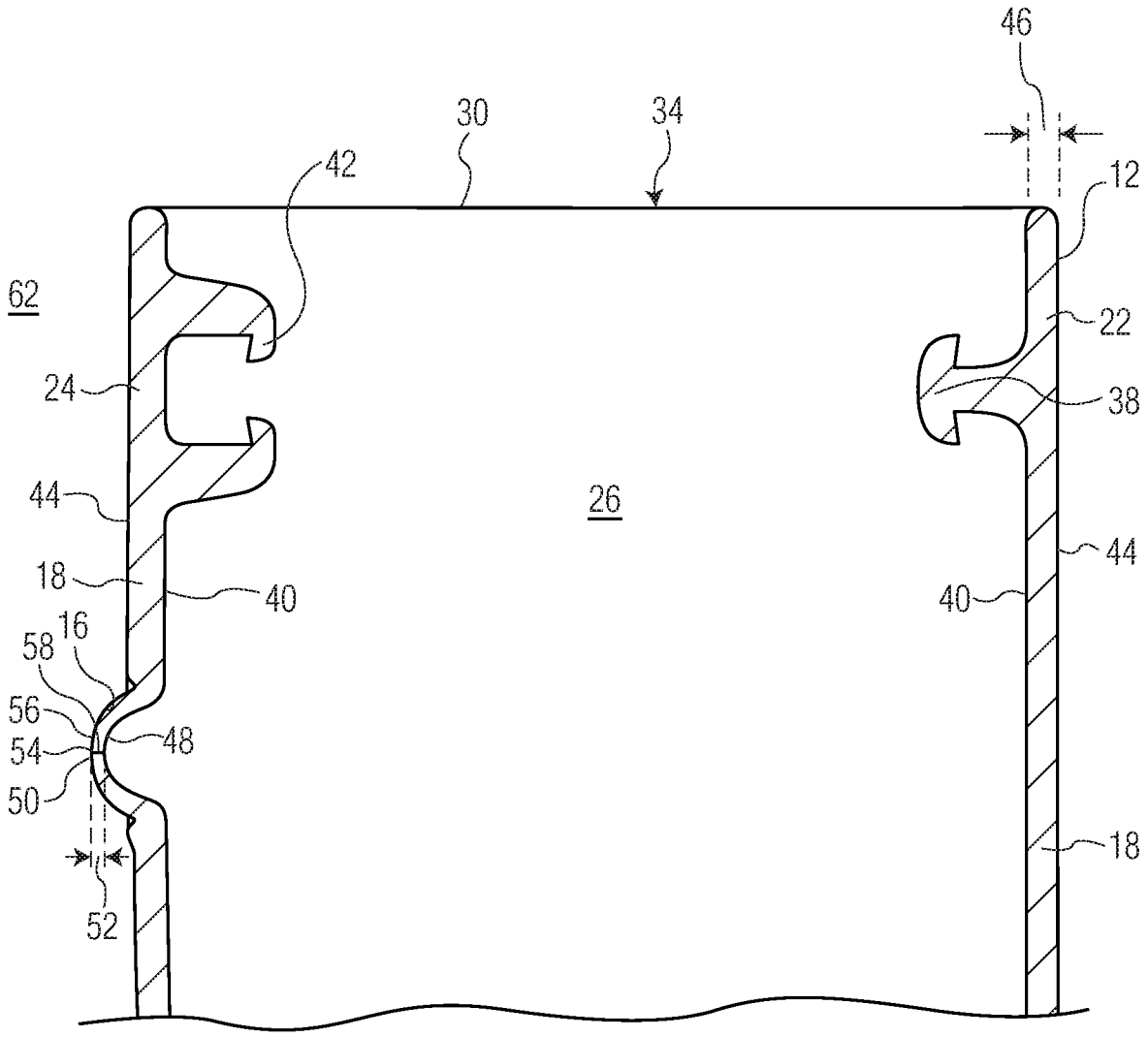
FIG. 2 is a cross-section along the line 2-2 of FIG. 1.

Referring now to FIG. 2, a cross-section along the line 2-2 of FIG. 1, container 12 is shown in open condition 34. Container 12 has sidewall 18 comprised of one sidewall 22 and opposite sidewall 24. Sidewall 18 has an inner surface 40 facing cavity 26 and an outer surface 44 external to container 12. Inner surface 40 and outer surface 44 together define a sidewall thickness 46. In the preferred embodiment, sidewall thickness is in the range of 0.075 inches to 0.095 inches and preferably 0.085 inches. Two-part seal 14 (FIG. 1) is shown separated with hook 38 formed along inner surface 40 of one wall 22 and clasp 42 formed along inner surface 40 of opposite wall 24. Hook 38 and clasp 42 are arranged on inner surface 40 of sidewall 18 to form an airtight seal closing opening 30 and isolating cavity 26 from the external environment when hook 38 is embedded in clasp 42 but otherwise opening 30 remains open and cavity 26 is exposed to the external environment 62. Formed as part of sidewall 18 is vent 16. Vent 16 is integrally formed in one of the sidewalls 22 and 24 of the same material as the sidewalls 22 and 24. In the preferred embodiment, the sidewalls 22 and 24 together with vent 16 are constructed of an impermeable flexible polymeric material and preferably any one of suitable food grade silicones known to those skilled in the art. Vent 16 includes a one-way valve 48 in the form of dimple 50. Dimple 50 has a dimple thickness 52. In the preferred embodiment, dimple thickness 52 is in the range of 0.025 inches to 0.045 inches and preferably 0.035 inches. While in the preferred embodiment dimple thickness 52 is less than sidewall thickness 46, the invention works with dimple thickness 52 being equal to or greater than sidewall thickness 46. Dimple 50 includes a cut opening 54 at apex 56. In the preferred embodiment, cut opening 54 can be a slit 58 or a duck bill valve (not shown).

Although exemplary embodiments have been shown and described, it will be clear to those of ordinary skill in the art that a number of changes, modifications, or alterations to the disclosure as described may be made. All such changes, modifications, and alterations should therefore be seen as within the scope of the disclosure.

What is claimed is:

1. A container having opposing sidewalls and a bottom defining a cavity, the sidewalls forming a neck defining an opening opposite the bottom, the sidewalls having an inner surface facing the cavity and an outer surface external to the container, the sidewalls having a thickness;

A two-part seal formed on the inner surface of the sidewalls adjacent the neck, the two-part seal having a hook formed on one sidewall and a clasp formed on an opposite sidewall, the hook and clasp are arranged on the inner surface of the sidewalls to form an airtight seal isolating the cavity from an external environment when the hook is embedded in the clasp but otherwise forming an opening in the container;

A vent integrally formed in one of the sidewalls, the vent is further comprised of a dimple having a dimple thickness that is thinner than the sidewall thickness of the sidewalls, the dimple is concave when viewed from the cavity and has a slit formed at an apex that is closed except when the container is sealed and an internal pressure is created that is higher than an external pressure on the outer surface of the sidewalls; and Wherein the sidewalls have a thickness in the range of 0.075 inches to 0.095 inches and the dimple has a thickness in the range of 0.025 inches to 0.045 inches.

2. The vented sealable bag of claim 1, constructed of a flexible polymeric material.

3. The vented sealable bag of claim 1, constructed of silicone.

4. The vented sealable bag of claim 1, wherein the bottom forms a rectangular platform.

5. The vented sealable bag of claim 1, wherein the bottom forms a platform sufficient to support the vented sealable bag.

6. The vented sealable bag of claim 1, wherein the vent has a dimple thickness equal to or greater than the thickness of the sidewalls.

7. The vented sealable bag of claim 1, wherein the container, two-part seal and the vent are constructed of an impermeable flexible material.

8. The vented sealable bag of claim 1, wherein the container, two-part seal and the vent are constructed of silicone.

9. The vented sealable bag of claim 1, wherein the cut opening is a slit.

10. The vented sealable bag of claim 1, wherein the container, two-part seal and the vent are constructed of a flexible material.

11. The vented sealable bag of claim 1, wherein the container, two-part seal and the vent are constructed of the same material.

* * * * *